US009041275B2

(12) United States Patent
Abe et al.

(10) Patent No.: US 9,041,275 B2
(45) Date of Patent: May 26, 2015

(54) SPARK PLUG FOR INTERNAL COMBUSTION ENGINE AND METHOD OF MANUFACTURING THE SAME

(71) Applicant: DENSO CORPORATION, Kariya, Aichi-pref. (JP)

(72) Inventors: Nobuo Abe, Yokkaichi (JP); Yuki Murayama, Toyoake (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/299,276

(22) Filed: Jun. 9, 2014

(65) Prior Publication Data

US 2014/0361679 A1 Dec. 11, 2014

(30) Foreign Application Priority Data

Jun. 10, 2013 (JP) ..... 2013-121568

(51) Int. Cl.
*H01T 13/39* (2006.01)
*H01T 21/02* (2006.01)
*F02P 3/02* (2006.01)

(52) U.S. Cl.
CPC . *H01T 13/39* (2013.01); *F02P 3/02* (2013.01); *H01T 21/02* (2013.01)

(58) Field of Classification Search
USPC ..... 313/118–145; 123/169 R, 169 EL, 32, 123/41, 310
See application file for complete search history.

(56) References Cited

U.S. PATENT DOCUMENTS

| | | | | |
|---|---|---|---|---|
| 5,465,022 | A * | 11/1995 | Katoh et al. | 313/144 |
| 6,078,129 | A * | 6/2000 | Gotou et al. | 313/141 |
| 7,083,488 | B2 * | 8/2006 | Taniguchi et al. | 445/7 |
| 2003/0038577 | A1 * | 2/2003 | Hori et al. | 313/141 |

FOREIGN PATENT DOCUMENTS

| | | |
|---|---|---|
| JP | 07-037673 | 2/1995 |
| JP | 2001-043955 | 2/2001 |

* cited by examiner

*Primary Examiner* — Tracie Y Green
(74) *Attorney, Agent, or Firm* — Nixon & Vanderhye P.C.

(57) ABSTRACT

In a spark plug, a center electrode includes a base member and a discharge chip that has a higher melting point than the base member. The base member and the discharge chip are joined to each other by both a weld and a diffusion layer. The weld is formed, by fusion welding, along an outer periphery of an interface between the base member and the discharge chip into an annular shape. The weld is made up of those parts of the base member and the discharge chip which are molten and mixed together during the fusion welding and solidified after the fusion welding. The diffusion layer is formed radially inside the annular weld. The diffusion layer is made up of those parts of the base member and the discharge chip which are diffused into each other across the interface between the base member and the discharge chip.

7 Claims, 5 Drawing Sheets

SPARK PLUG FOR INTERNAL COMBUSTION ENGINE AND METHOD OF MANUFACTURING THE SAME

CROSS-REFERENCE TO RELATED APPLICATION

This application is based on and claims priority from Japanese Patent Application No. 2013-121568 filed on Jun. 10, 2013, the content of which is hereby incorporated by reference in its entirety into this application.

BACKGROUND

1. Technical Field

The present invention relates to spark plugs for internal combustion engines and methods of manufacturing the spark plugs.

2. Description of the Related Art

In a spark plug for an internal combustion engine, for the purpose of extending the service life of the spark plug, a refractory metal material (e.g., a tungsten alloy) is generally used for making a center electrode of the spark plug. Here, the term "refractory metal material" denotes a metal material having a high melting point.

However, a refractory metal material is generally expensive. Therefore, for reducing the manufacturing cost, it is possible to make a base portion of the center electrode with an inexpensive metal material (e.g., a nickel alloy) and a distal portion of the center electrode, which is particularly easy to be consumed in the center electrode, with a refractory metal material. In this case, since the refractory metal material generally has a low coefficient of thermal expansion, it is important to reduce thermal stress induced in the center electrode due to the difference in coefficient of thermal expansion between the refractory metal material and the inexpensive metal material of which the base portion is made.

For example, Japanese Unexamined Patent Application Publication No. H7-037673 discloses a spark plug in which the center electrode has its base portion made of a nickel alloy and its distal portion (or discharge chip) made of a tungsten alloy. The distal portion is joined to a distal end of the base portion by laser welding to form a weld therebetween. More specifically, the weld is made up of those parts of the base portion and the distal portion which are molten and mixed together during the laser welding and solidified after the laser welding. Moreover, the weld is formed, along the outer periphery of the interface between the base portion and the distal portion, into an annular shape.

However, the spark plug disclosed in the above patent document involves the following problems.

In the spark plug, the base portion and the distal portion of the center electrode are joined to each other by only the annular weld formed along the outer periphery of the interface between the base portion and the distal portion. That is, on the radially inside of the annular weld, there exists a non-joined region where the base portion and the distal portion are not joined to each other. Consequently, concentration of thermal stress may occur at the boundary between the weld and the non-joined region, thereby causing a joining fault, such as cracks, to occur at the boundary.

In addition, one may consider forming the weld over the entire interface between the base portion and the distal portion, thereby eliminating the non-joined region. However, in this case, since the melting point of the base portion is lower than that of the distal portion, the base portion may be excessively molten during the laser welding, causing the molten material of the base portion to be scattered and volatilized.

SUMMARY

According to exemplary embodiments, there is provided a spark plug for an internal combustion engine. The spark plug includes a ground electrode and a center electrode. The center electrode includes a base member and a discharge chip that is joined to a distal end of the base member to face the ground electrode through a spark gap formed therebetween. The discharge chip has a higher melting point than the base member. The base member and the discharge chip are joined to each other by both a weld and a diffusion layer. The weld is formed, by fusion welding, along an outer periphery of an interface between the base member and the discharge chip into an annular shape. The weld is made up of those parts of the base member and the discharge chip which are molten and mixed together during the fusion welding and solidified after the fusion welding. The diffusion layer is formed radially inside the annular weld. The diffusion layer is made up of those parts of the base member and the discharge chip which are diffused into each other across the interface between the base member and the discharge chip.

With the above configuration, the base member and the discharge chip of the center electrode can be joined to each other over the entire interface therebetween. Consequently, it is possible to prevent a sharp change of thermal stress from occurring at the interface and in its vicinity. In other words, it is possible to cause thermal stress generated between the base member and the discharge chip to be evenly distributed. As a result, it is possible to prevent local concentration of thermal stress from occurring in the center electrode.

Moreover, both the coefficients of thermal expansion of the weld and the diffusion layer are lower than the coefficient of thermal expansion of the base member and higher than the coefficient of thermal expansion of the discharge chip. Therefore, the differences of the coefficients of thermal expansion of the weld and the diffusion layer from the coefficients of thermal expansion of the base member and the discharge chip are smaller than the difference between the coefficients of thermal expansion of the base member and the discharge chip. Consequently, it is possible to reduce thermal stress induced in the center electrode.

Accordingly, with the above configuration, it is possible to reliably join the base member and the discharge chip without causing a joining fault, such as cracks, to occur in the center electrode.

In addition, at the diffusion layer, the base member and the discharge chip are diffusion-joined to each other, not fusion-welded to each other. Consequently, it is possible to prevent the base member from being excessively molten during the fusion welding, thereby stably joining the base member and the discharge chip to each other.

In one embodiment, the diffusion layer is a first diffusion layer. At an interface of the weld with the base member and the discharge chip, there is formed a second diffusion layer where the materials of the base member and the weld are diffused into each other across the interface and the materials of the discharge chip and the weld are diffused into each other across the interface.

It is preferable that: $0.5\ \mu m \leq t\mathbf{1} \leq 20\ \mu m$; and $0.5\ \mu m \leq t\mathbf{2} \leq 20\ \mu m$, where t1 and t2 are respectively the thicknesses of the first and second diffusion layers.

It is also preferable that: 1300° C.≤M1≤1500° C.; and 2200° C.≤M2≤2800° C., where M1 and M2 are respectively the melting points of the base member and the discharge chip of the center electrode.

According to the exemplary embodiments, there is also provided a method of manufacturing the spark plug. The method includes a preliminary joining step, a fusion welding step and a heat treatment step. In the preliminary joining step, the base member and the discharge chip of the center electrode are joined by resistance welding while being pressed to abut each other. In the fusion welding step, the base member and the discharge chip are laser-welded to form the annular weld along the outer periphery of the interface between the base member and the discharge chip. In the heat treatment step, both the base member and the discharge chip are heated to form the diffusion layer (or the first diffusion layer) on the radially inside of the annular weld.

With the above method, it is possible to easily and reliably form both the weld and the diffusion layer at the interface between the base member and the discharge chip. Consequently, it is possible to easily and reliably manufacture the spark which has the advantages as described above.

It is preferable that the preliminary joining step, the fusion welding step and the heat treatment step are sequentially performed in this order. In this case, it is possible to form the second diffusion layer at the interface of the weld with the base member and the discharge chip at the same time as forming the first diffusion layer at the interface between the base member and the discharge chip in the heat treatment step.

BRIEF DESCRIPTION OF THE DRAWINGS

The present invention will be understood more fully from the detailed description given hereinafter and from the accompanying drawings of exemplary embodiments, which, however, should not be taken to limit the invention to the specific embodiments but are for the purpose of explanation and understanding only.

In the accompanying drawings.

DESCRIPTION OF EMBODIMENTS

Figure 1:
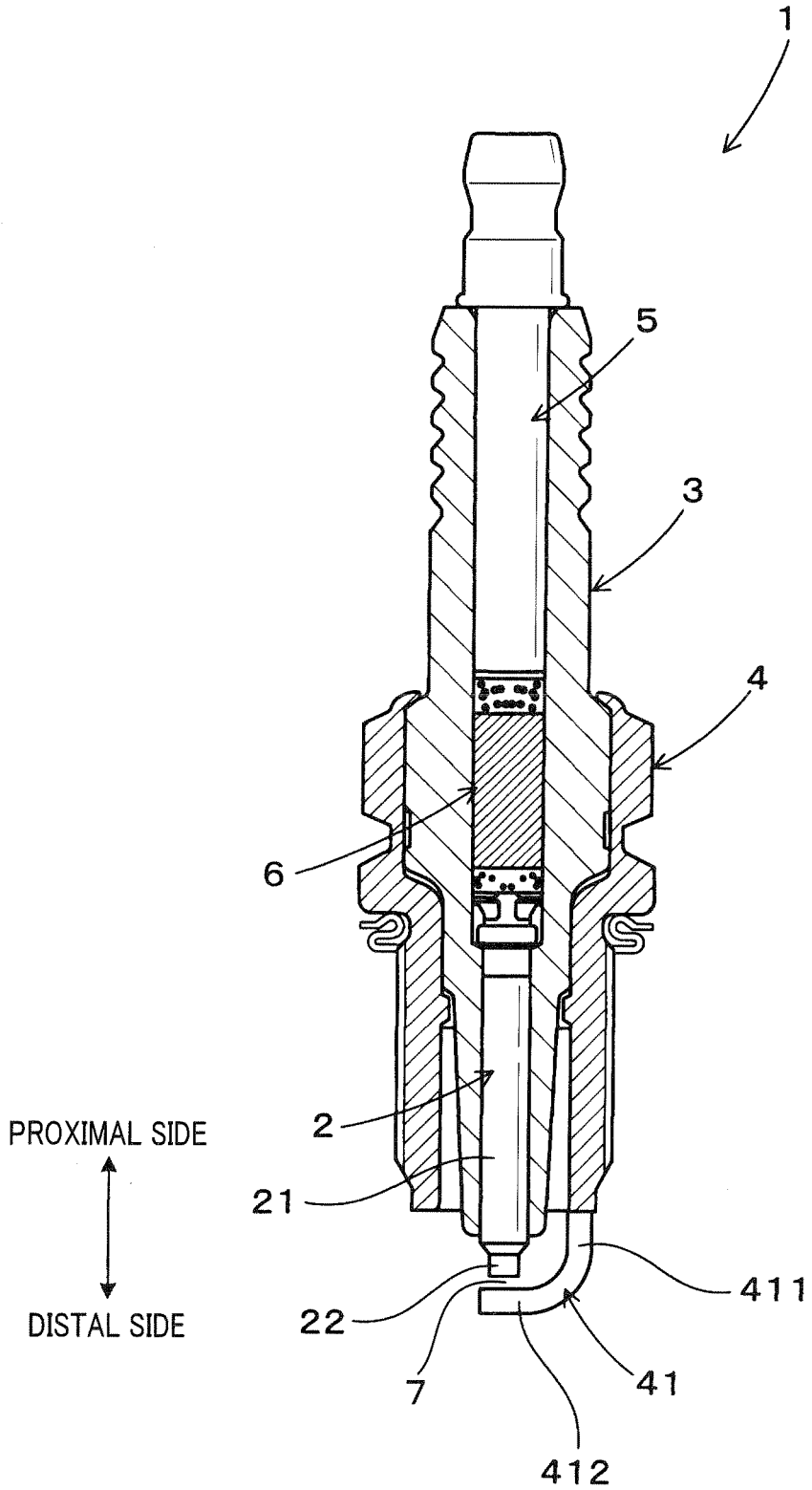
FIG. 1 is a schematic cross-sectional view illustrating the overall configuration of a spark plug according to a first embodiment.

Exemplary embodiments will be described hereinafter with reference to FIGS. 1-7. It should be noted that for the sake of clarity and understanding, identical components having identical functions throughout the whole description have been marked, where possible, with the same reference numerals in each of the figures and that for the sake of avoiding redundancy, descriptions of the identical components will not be repeated.

[First Embodiment]

This embodiment illustrates a spark plug 1 for an internal combustion engine of a motor vehicle.

Figure 2:
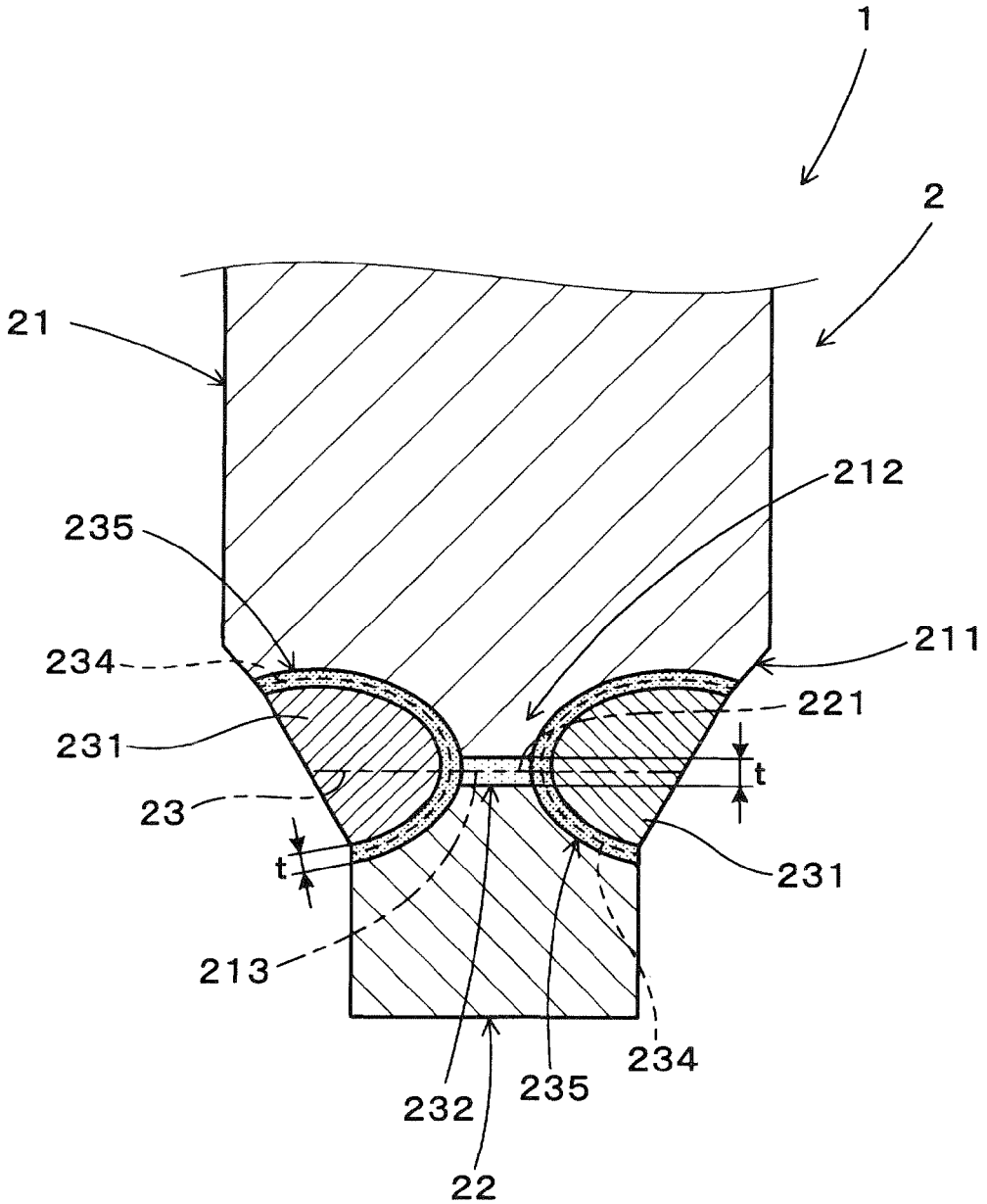
FIG. 2 is an enlarged cross-sectional view of part of a center electrode of the spark plug according to the first embodiment.

As shown in FIG. 1, the spark plug 1 includes a center electrode 2 and a ground electrode 41. Further, as shown in FIG. 2, the center electrode 2 includes a base member 21 and a discharge chip 22. The discharge chip 22 is joined to a distal end of the base member 21 to face the ground electrode 41 through a spark gap 7 (shown in FIG. 1) formed between the discharge chip 22 and the ground electrode 41. The discharge chip 22 has a higher melting point than the base member 21. The base member 21 and the discharge chip 22 are joined to each other by both a weld 231 and a first diffusion layer 232.

The weld 231 is formed, by fusion welding (more particularly, by laser welding in the present embodiment), along the outer periphery of an interface 23 between the base portion 21 and the distal chip 22, into an annular shape. The weld 231 is made up of those parts of the base member 21 and the discharge chip 22 which are molten and mixed together during the fusion welding and solidified after the fusion welding.

The first diffusion layer 232 is formed radially inside the annular weld 231. The first diffusion layer 232 is made up of those parts of the base member 21 and the discharge chip 22 which are diffused into each other across the interface 23 between the base portion 21 and the distal chip 22.

Hereinafter, the configuration of the spark plug 1 according to the present embodiment will be described in detail.

The spark plug 1 is designed to ignite the air-fuel mixture in a combustion chamber of the engine. The spark plug 1 has one axial end to be connected to an ignition coil (not shown) and the other axial end to be placed inside the combustion chamber. In addition, hereinafter, as shown in FIG. 1, the axial side where the spark plug 1 is to be connected to the ignition coil will be referred to as "proximal side"; the other axial side where the spark plug 1 is to be placed inside the combustion chamber will be referred to as "distal side".

As shown in FIG. 1, the spark plug 1 includes the center electrode 2, a tubular insulator 3, a tubular metal shell (or housing) 4 retaining the insulator 3 therein, the ground electrode 41 that is joined to a distal end of the metal shell 4, a stem 5 and a resistor 6. All of the stem 5, the resistor 6 and the center electrode 2 are secured in the insulator 3.

Specifically, in the present embodiment, the insulator 3 is formed of alumina into a substantially hollow cylindrical shape. In the insulator 3, the stem 5, the resistor 6 and the center electrode 2 are sequentially arranged from the proximal side in this order.

The metal shell 4 also has a substantially hollow cylindrical shape. The metal shell 4 is arranged to cover the insulator 3 from about the axially center position of the insulator 3 distalward such that a distal end portion of the insulator 3 protrudes outside of the metal shell 4.

The ground electrode 41 is bent at substantially a right angle to include a first portion 411 and a second portion 412. The first portion 411 extends from the distal end of the metal shell 4 distalward. The second portion 412 extends from a distal end of the first portion 411 radially inward to have an end part thereof axially facing the discharge chip 22 of the center electrode 2 through the spark gap 7 formed therebetween.

Referring to FIGS. 1 and 2, the center electrode 2 includes the base member 21 that has a substantially cylindrical shape and the discharge chip 22 that is joined to the distal end of the base member 21.

Figure 3:
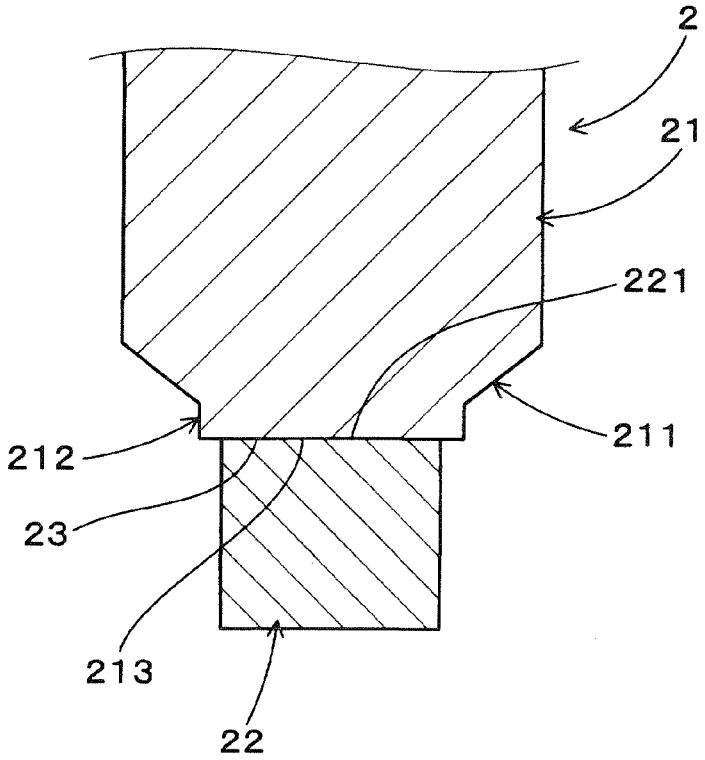
FIG. 3 is an enlarged cross-sectional view illustrating the part of the center electrode before a preliminary joining step.

The base member 21 is made of a nickel alloy which has a melting point of, for example, 1400° C. Moreover, as shown in FIG. 3, before being joined to the discharge chip 22, the base member 21 includes a taper portion 211 and a pedestal portion 212. The taper portion 211 is tapered distalward to have the shape of a truncated cone. The pedestal portion 212 extends from a distal end of the taper portion 211 distalward and has a distal end face 213 that represents the distal end face of the base member 21. The pedestal portion 212 has a cylindrical shape with its diameter being equal to the diameter of the taper portion 211 at the distal end of the taper portion 211.

In addition, it should be noted that the base member 21 may also be made of other metal materials which preferably have a melting point M1 in the range of 1300° C. to 1500° C. (i.e., 1300° C.≤M1≤1500° C.). Those metal materials include, for example, iron alloys such as stainless steel.

The discharge chip 22 is made of a tungsten alloy which has a melting point of, for example, 2400° C. Moreover, as shown in FIG. 3, before being joined to the base member 21, the discharge chip 22 has a cylindrical shape with its diameter set to be smaller than the diameter of the pedestal portion 212 of the base member 21.

In addition, it should be noted that the discharge chip 22 may also be made of other metal materials which preferably have a melting point M2 in the range of 2200° C. to 2800° C. (i.e., 2200° C.≤M2≤2800° C.). Those metal materials include, for example, iridium, ruthenium, rhenium, molybdenum, zirconium, hafnium and their alloys.

As shown in FIG. 3, the base member 21 and the discharge chip 22 are placed so that the distal end face 213 of the base member 21 abuts a proximal end face 221 of the discharge chip 22. In addition, the boundary surface where the distal end face 213 of the base member 21 and the proximal end face 221 of the discharge chip 22 are in contact with each other makes up the interface 23 between the base member 21 and the discharge chip 22.

Moreover, in the present embodiment, as shown in FIG. 2, after the base member 21 and the discharge chip 22 are joined to each other, there are the weld 231, the first diffusion layer 232 and a second diffusion layer 235 formed in the center electrode 2.

The weld 231 is formed, along the outer periphery of the interface 23 between the base member 21 and the discharge chip 22, into the annular shape. At the weld 231, part of the base member 21 and part of the discharge chip 22 are molten and mixed together. More specifically, in the present embodiment, an outer peripheral part of the taper portion 211 of the base member 21, an outer peripheral part of the pedestal portion 212 of the base member 21, and an outer peripheral part of the discharge chip 22 at the proximal end of the discharge chip 22 are molten and mixed together to form the weld 231.

At the boundaries between the base member 21 and the weld 231 and between the discharge chip 22 and the weld 231, there is formed an interface 234 of the weld 231 with the base member 21 and the discharge chip 22. Further, across the interface 234, there is formed the second diffusion layer 235 where the materials of the base member 21 and the weld 231 are diffused into each other and the materials of the discharge chip 22 and the weld 231 are diffused into each other. In addition, in the present embodiment, the thickness t2 of the second diffusion layer 235 is set to be in the range of, for example, 0.5 to 20 μm (i.e., 0.5 μm≤t2≤20 μm).

On the radially inside of the annular weld 231 at the interface 23 between the base member 21 and the discharge chip 22, there is formed the first diffusion layer 232 where the materials of the base member 21 and the discharge chip 22 are diffused into each other across the interface 23. More specifically, in the present embodiment, on the radially inside of the annular weld 231, the first diffusion layer 232 is formed across the interface 23 of the distal end face 213 of the base member 21 and the proximal end face 221 of the discharge chip 22. In addition, the thickness t1 of the first diffusion layer 232 is also set to be in the range of, for example, 0.5 to 20 μm (i.e., 0.5 μm≤t1≤20 μm).

Next, a method of manufacturing the spark plug 1 according to the present embodiment will be described.

Figure 6:
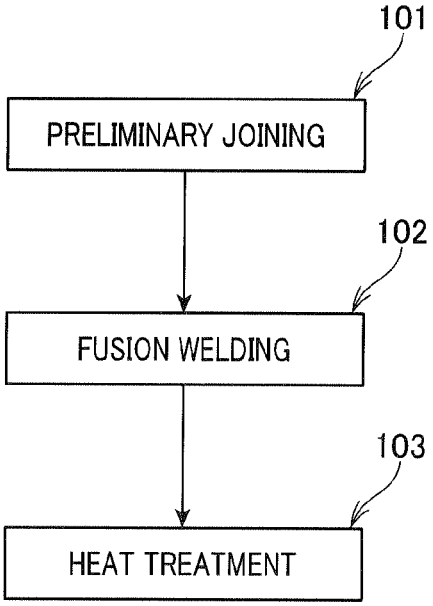
FIG. 6 is a flow chart illustrating a method of manufacturing the spark plug according to the first embodiment.

As shown in FIG. 6, in the present embodiment, the method includes a preliminary joining step 101, a fusion welding step 102 and a heat treatment step 103.

In the preliminary joining step 101, the base member 21 and the discharge chip 22 of the center electrode 2 are joined to each other by resistance welding.

Figure 4:
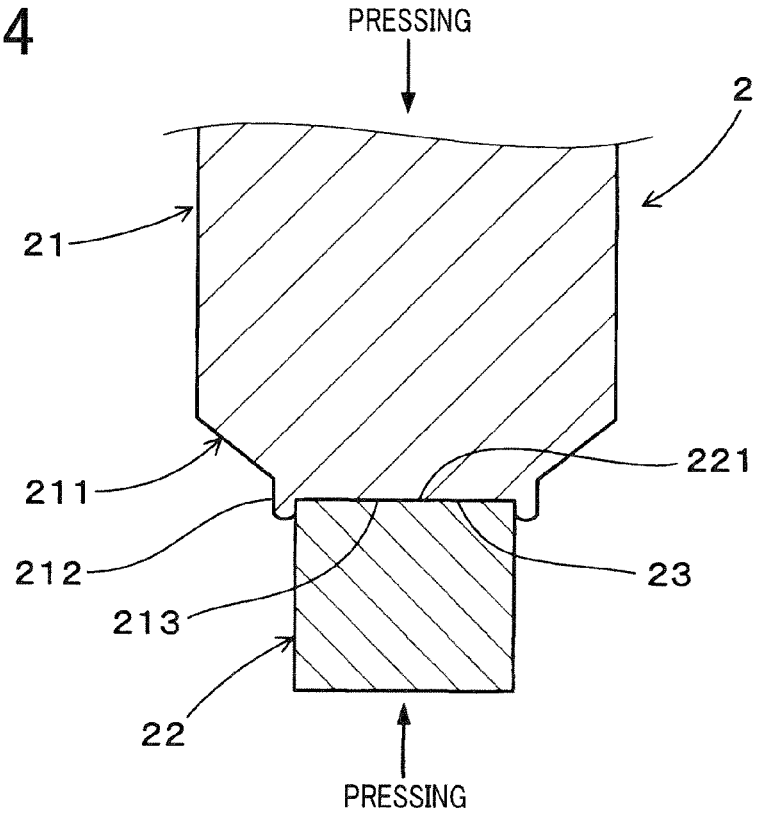
FIG. 4 is an enlarged cross-sectional view illustrating the part of the center electrode after the preliminary joining step and before a fusion welding step.

Specifically, referring to FIG. 4, in this step, the base member 21 and the discharge chip 22 are first interposed between a pair of welding electrodes (not shown), with the distal end face 213 of the base member 21 and the proximal end face 221 of the discharge chip 22 abutting each other. Then, the base member 21 and the discharge chip 22 are pressed between the pair of welding electrodes while being supplied with welding current via the pair of welding electrodes. Consequently, the base member 21 and the discharge chip 22 are joined to each other by the resistance heat (i.e., the heat generated by the resistance of the base member 21 and the discharge chip 22 to the welding current).

More specifically, in this step, the base member 21 is softened by the resistance heat. At the same time, the base member 21 and the discharge chip 22 are pressed between the pair of welding electrodes with such a pressing force as to be capable of deforming the softened base member 21. Consequently, the softened base member 21 is deformed so that the distal end face 213 of the base member 21 is adapted to the minor irregularity (or concavity and convexity) of the proximal end face 221 of the discharge chip 22. As a result, the base member 21 and the discharge chip 22 are reliably brought into contact with and joined to each other at the interface 23 therebetween.

In the fusion welding step 102, the base member 21 and the discharge chip 22 are further joined to each other by laser welding.

Figure 5:
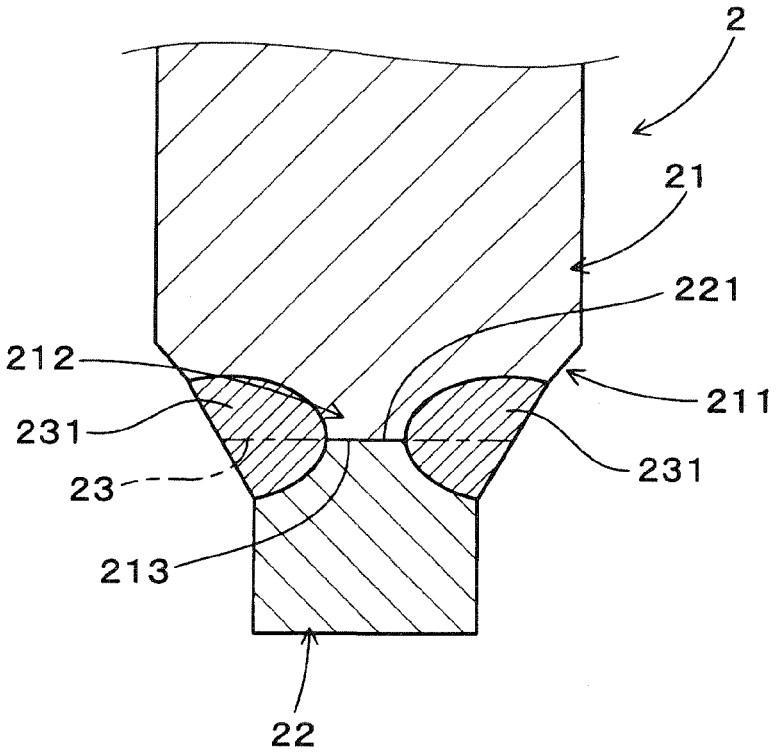
FIG. 5 is an enlarged cross-sectional view illustrating the part of the center electrode after the fusion welding step.

Specifically, referring to FIG. 5, in this step, a laser beam is irradiated along the outer periphery of the interface 23 between the base member 21 and the discharge chip 22 with a shielding gas being concurrently supplied to the outer periphery. Consequently, part of the base member 21 and part of the discharge chip 22 are molten and mixed together to form the annular weld (or fusion-welded joint) 231 between the base member 21 and the discharge chip 22. More specifically, in the present embodiment, the outer peripheral part of the taper portion 211 of the base member 21, the outer peripheral part of the pedestal portion 212 of the base member 21, and the outer peripheral part of the discharge chip 22 at the proximal end of the discharge chip 22 are molten and mixed together to form the annular weld 231 along the outer periphery of the interface 23.

In the heat treatment step 103, the center electrode 2 is heat-treated to form the first and second diffusion layers 232 and 235 therein.

Specifically, in this step, the center electrode 2 is heated in an atmosphere of, for example, 900° C. for 2 hours. Consequently, as shown in FIG. 2, on the radially inside of the annular weld 231, the materials of the base member 21 and the discharge chip 22 are diffused into each other across the interface 23, thereby forming the first diffusion layer 232. At the same time, the materials of the weld 21 and the base member 21 are diffused into each other across the interface 234 and the materials of the weld 231 and the discharge chip 22 are diffused into each other across the interface 234, thereby forming the second diffusion layer 235.

As a result, the center electrode 2 of the spark plug 1 according to the present embodiment is finally obtained.

According to the present embodiment, it is possible to achieve the following advantageous effects.

In the present embodiment, the center electrode 2 includes the base member 21 and the discharge chip 22 that is joined to the distal end of the base member 21 to face the ground electrode 41 through the spark gap 7 formed therebetween. The melting point of the discharge chip 22 is higher than that of the base member 21. The base member 21 and the discharge chip 22 of the center electrode 2 are joined to each other by both the weld 231 and the first diffusion layer 232. The weld 231 is formed, by laser welding, along the outer periphery of the interface 23 between the base member 21 and the discharge chip 22 into the annular shape. The weld 231 is made up of those parts of the base member 21 and the discharge chip 22 which are molten and mixed together during the laser welding and solidified after the laser welding. The first diffusion layer 232 is formed radially inside the annular weld 231. The first diffusion layer 232 is made up of those parts of the base member 21 and the discharge chip 22 which are diffused into each other across the interface 23 between the base member 21 and the discharge chip 22.

With the above configuration, the base member 21 and the discharge chip 22 of the center electrode 2 can be joined to each other over the entire interface 23 therebetween. Consequently, it is possible to prevent a sharp change of thermal stress from occurring at the interface 23 and in its vicinity. In other words, it is possible to cause thermal stress generated between the base member 21 and the discharge chip 22 to be evenly distributed. As a result, it is possible to prevent local concentration of thermal stress from occurring in the center electrode 2.

Moreover, both the coefficients of thermal expansion of the weld 231 and the first diffusion layer 232 are lower than the coefficient of thermal expansion of the base member 21 and higher than the coefficient of thermal expansion of the discharge chip 22. Therefore, the differences of the coefficients of thermal expansion of the weld 231 and the first diffusion layer 232 from the coefficients of thermal expansion of the base member 21 and the discharge chip 22 are smaller than the difference between the coefficients of thermal expansion of the base member 21 and the discharge chip 22. Consequently, it is possible to reduce thermal stress induced in the center electrode 2.

Accordingly, with the above configuration, it is possible to reliably join the base member 21 and the discharge chip 22 without causing a joining fault, such as cracks, to occur in the center electrode 2.

In addition, at the first diffusion layer 232, the base member 21 and the discharge chip 22 are diffusion-joined to each other, not fusion-welded to each other. Consequently, it is possible to prevent the base member 21 from being excessively molten during the laser welding, thereby stably joining the base member 21 and the discharge chip 22 to each other.

Moreover, in the present embodiment, at the interface 234 of the weld 231 with the base member 21 and the discharge chip 22, there is formed the second diffusion layer 235 where the materials of the base member 21 and the weld 231 are diffused into each other across the interface 234 and the materials of the discharge chip 22 and the weld 231 are diffused into each other across the interface 234.

Consequently, with the second diffusion layer 235, it is possible to reduce thermal stress induced by the differences in coefficient of thermal expansion between the base member 21 and the weld 231 and between the discharge chip 22 and the weld 231. As a result, it is possible to more reliably prevent local concentration of thermal stress from occurring in the center electrode 2.

In the present embedment, 1300° C.≤M1≤1500° C. and 2200° C.≤M2≤2800° C., where M1 and M2 are respectively the melting points of the base member 21 and the discharge chip 22 of the center electrode 2.

Specifying the ranges of M1 and M2 as above, it is possible to reliably join the base member 21 and the discharge chip 22 to each other while securing a long service life of the center electrode 2.

More specifically, specifying M1 to be not lower than 1300° C., it is possible to prevent (M2−M1) from becoming too large, thereby allowing the base member 21 and the discharge chip 22 to be reliably joined to each other. Moreover, specifying M1 to be not higher than 1500° C., it is possible to make the base member 21 with an inexpensive metal material such as the nickel alloy described previously.

On the other hand, specifying M2 to be not lower than 2200° C., it is possible to make the discharge chip 22 with a refractory material, thereby securing a long service life of the center electrode 2. Moreover, specifying M2 to be not higher than 2800° C., it is possible to prevent (M2−M1) from becoming too large, thereby allowing the base member 21 and the discharge chip 22 to be reliably joined to each other.

In addition, it is further preferable that 800° C.≤(M2−M1)≤1400° C. In this case, it is possible to more reliably join the base member 21 and the discharge chip 22 to each other.

In the present embodiment, 0.5 μm≤t1≤20 μm, where t1 is the thickness of the first diffusion layer 232.

Specifying t1 to be not less than 0.5 μm, it is possible to reliably achieve the thermal stress-reducing effect of the first diffusion layer 232. Moreover, specifying t1 to be not greater than 20 μm, it is possible to prevent the time required for performing the heat treatment step 103 from becoming too long.

In the present embodiment, 0.5 μm≤t2≤20 μm, where t2 is the thickness of the second diffusion layer 235.

Specifying t2 to be not less than 0.5 μm, it is possible to reliably achieve the thermal stress-reducing effect of the second diffusion layer 235. Moreover, specifying t2 to be not greater than 20 μm, it is possible to prevent the time required for performing the heat treatment step 103 from becoming too long.

In the present embodiment, the method of manufacturing the spark plug 1 includes the preliminary joining step 101, the fusion welding step 102 and the heat treatment step 103. In the preliminary joining step 101, the base member 21 and the discharge chip 22 of the center electrode 2 are joined by resistance welding while being pressed to abut each other. In the fusion welding step 102, the base member 21 and the discharge chip 22 are laser-welded to form the annular weld 231 along the outer periphery of the interface 23 between the base member 21 and the discharge chip 22. In the heat treatment step 103, both the base member 21 and the discharge chip 22 are heated to form the first diffusion layer 232 on the radially inside of the annular weld 231.

With the above method, it is possible to easily and reliably form both the weld 231 and the first diffusion layer 232 at the interface 23 between the base member 21 and the discharge chip 22. Consequently, it is possible to easily and reliably manufacture the spark 1 which has the advantages as described above.

Further, in the present embodiment, the preliminary joining step 101, the fusion welding step 102 and the heat treatment step 103 are sequentially performed in this order.

Consequently, it is possible to form the second diffusion layer 235 at the interface 234 of the weld 231 with the base member 21 and the discharge chip 22 at the same time as forming the first diffusion layer 232 at the interface 23 between the base member 21 and the discharge chip 22 in the heat treatment step 103.

[Second Embodiment]

In the first embodiment, as described previously, the preliminary joining step 101, the fusion welding step 102 and the heat treatment step 103 are sequentially performed in this order.

In comparison, in the present embodiment, the heat treatment step 103 is performed after the preliminary joining step 101 but before the fusion welding step 102.

Figure 7:
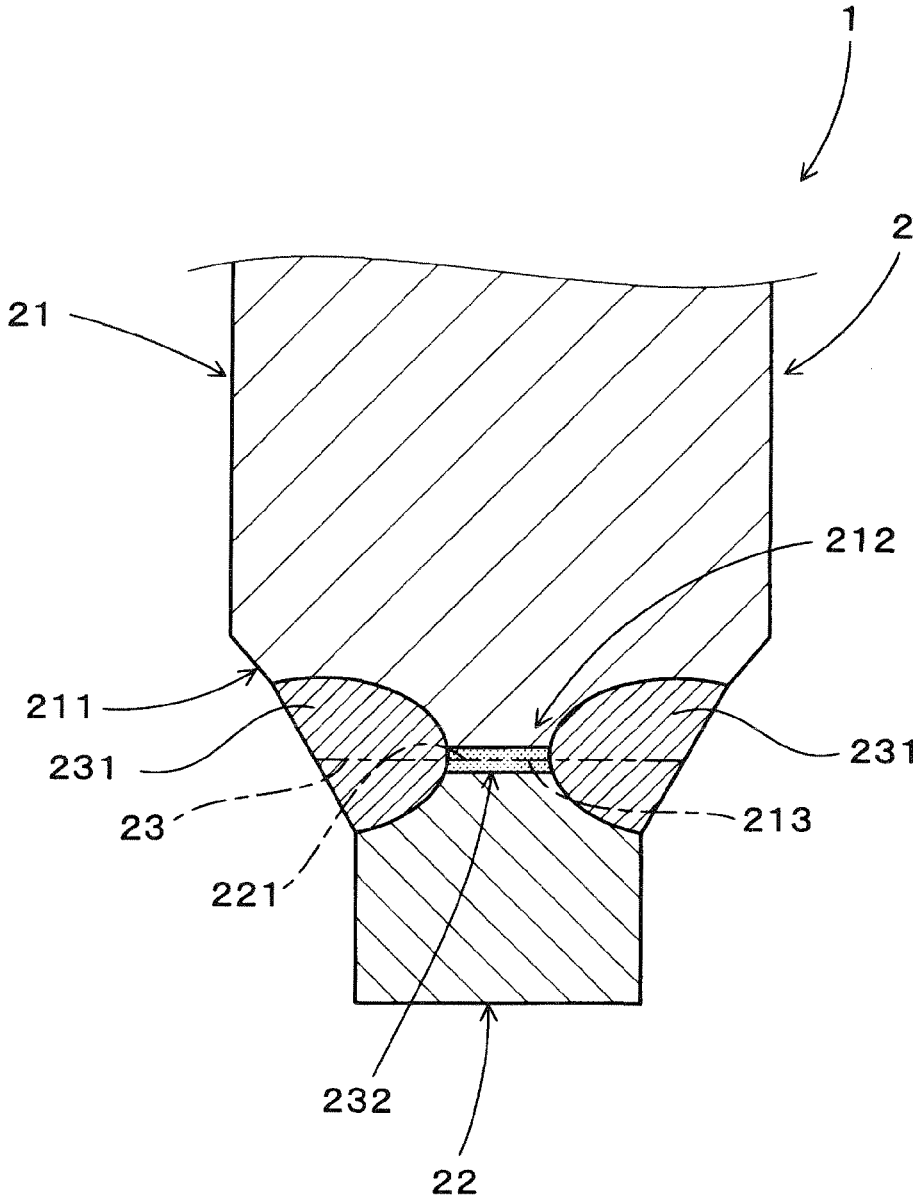
FIG. 7 is an enlarged cross-sectional view of part of a center electrode according to a second embodiment.

Consequently, as shown in FIG. 7, in the resultant center electrode 2, there are both the weld 231 and the first diffusion layer 232 formed between the base member 21 and the discharge chip 22, but no second diffusion layer 235 formed between the weld 231 and the base member 21 and between the weld 231 and the discharge chip 22.

With the above configuration, it is still possible to reliably join the base member 21 and the discharge chip 22 without causing a joining fault, such as cracks, to occur in the center electrode 2. Moreover, it is also possible to prevent the base member 21 from being excessively molten in the fusion welding step 102, thereby stably joining the base member 21 and the discharge chip 22 to each other.

While the above particular embodiments have been shown and described, it will be understood by those skilled in the art that various modifications, changes, and improvements may be made without departing from the spirit of the present invention.

For example, in the first embodiment, the ground electrode 41 has no discharge chip provided therein. However, it is also possible to provide a discharge chip on the end part of the second portion 412 of the ground electrode 41 so as to axially face the discharge chip 22 of the center electrode 2 through the spark gap 7.

What is claimed is:

1. A spark plug for an internal combustion engine, the spark plug comprising:

a ground electrode; and a center electrode including a base member and a discharge chip that is joined to a distal end of the base member to face the ground electrode through a spark gap formed therebetween, the discharge chip having a higher melting point than the base member, wherein the base member and the discharge chip of the center electrode are joined to each other by both a weld and a diffusion layer, the weld is formed, by fusion welding, along an outer periphery of an interface between the base member and the discharge chip into an annular shape, the weld being made up of those parts of the base member and the discharge chip which are molten and mixed together during the fusion welding and solidified after the fusion welding, and the diffusion layer is formed radially inside the annular weld, the diffusion layer being made up of those parts of the base member and the discharge chip which are diffused into each other across the interface between the base member and the discharge chip.

2. The spark plug as set forth in claim 1, wherein the diffusion layer is a first diffusion layer, and at an interface of the weld with the base member and the discharge chip, there is formed a second diffusion layer where the materials of the base member and the weld are diffused into each other across the interface and the materials of the discharge chip and the weld are diffused into each other across the interface.

3. The spark plug as set forth in claim 2, wherein:

$0.5\ \mu m \leq t1 \leq 20\ \mu m$; and $0.5\ \mu m \leq t2 \leq 20\ \mu m$, where t1 and t2 are respectively the thicknesses of the first and second diffusion layers.

4. The spark plug as set forth in claim 1, wherein:

$1300°\ C. \leq M1 \leq 1500°\ C.$; and $2200°\ C. \leq M2 \leq 2800°\ C.$, where M1 and M2 are respectively the melting points of the base member and the discharge chip of the center electrode.

5. The spark plug as set forth in claim 1, wherein $0.5\ \mu m \leq t1 \leq 20\ \mu m$, where t1 is the thickness of the diffusion layer.

6. A method of manufacturing spark plug comprising:

a ground electrode; and a center electrode including a base member and a discharge chip that is joined to a distal end of the base member to face the ground electrode through a spark gap formed therebetween, the discharge chip having a higher melting point than the base member, wherein the base member and the discharge chip of the center electrode are joined to each other by both a weld and a diffusion layer, the weld is formed, by fusion welding along an outer periphery of an interface between the base member and the discharge chip into an annular shape, the weld being made up of those parts of the base member and the discharge chip which are molten and mixed together during the fusion welding and solidified after the fusion welding, and the diffusion layer is formed radially inside the annular weld, the diffusion layer being made up of those parts of the base member and the discharge chip which are diffused into each other across the interface between the base member and the discharge chip;

the method comprising:

a preliminary joining step in which the base member and the discharge chip of the center electrode are joined by resistance welding while being pressed to abut each other;

a fusion welding step in which the base member and the discharge chip are laser-welded to form the annular weld along the outer periphery of the interface between the base member and the discharge chip; and a heat treatment step in which both the base member and the discharge chip are heated to form the diffusion layer on the radially inside of the annular weld.

7. The method as set forth in claim 6, wherein the preliminary joining step, the fusion welding step and the heat treatment step are sequentially performed in this order.

* * * * *